US006805258B2

(12) United States Patent
Cross

(10) Patent No.: US 6,805,258 B2
(45) Date of Patent: Oct. 19, 2004

(54) CAPSULE DISPENSER

(75) Inventor: Robert Cross, Crystal Lake, IL (US)

(73) Assignee: Dordan Manufacturing Co., Woodstock, IL (US)

( * ) Notice: Subject to any disclaimer, the term of this patent is extended or adjusted under 35 U.S.C. 154(b) by 34 days.

(21) Appl. No.: 10/283,464

(22) Filed: Oct. 30, 2002

(65) Prior Publication Data

US 2003/0209558 A1 Nov. 13, 2003

Related U.S. Application Data

(60) Provisional application No. 60/379,168, filed on May 9, 2002.

(51) Int. Cl.[7] ..... G07F 11/66
(52) U.S. Cl. ..... 221/25
(58) Field of Search ..... 221/25; 206/531, 206/532, 534.1, 534.2, 538, 539, 533

(56) References Cited

U.S. PATENT DOCUMENTS 3,165,234 A * 1/1965 Conklin et al. ..... 221/302
4,015,717 A * 4/1977 Richardson et al. ..... 206/534
4,154,365 A * 5/1979 Lorca ..... 221/4
4,165,709 A * 8/1979 Studer ..... 116/308
4,298,125 A * 11/1981 Berghahn et al. ..... 206/531
4,646,936 A * 3/1987 Frazier et al. ..... 221/5
4,871,093 A * 10/1989 Burshtain et al. ..... 222/213
5,037,000 A * 8/1991 Selame ..... 221/303
5,775,536 A * 7/1998 Lambelet et al. ..... 221/5
6,244,442 B1 * 6/2001 Inoue et al. ..... 206/531
6,364,155 B1 * 4/2002 Wolfe ..... 221/25
6,502,717 B1 * 1/2003 Wolfe ..... 221/25
6,669,022 B2 * 12/2003 Donegan ..... 206/531

FOREIGN PATENT DOCUMENTS

WO 90/13878 * 11/1990
WO WO 97/08078 3/1997
WO WO 00/09419 2/2000
WO WO 00/43287 7/2000

* cited by examiner

*Primary Examiner*—David H. Bollinger
(74) *Attorney, Agent, or Firm*—Welsh & Katz, Ltd.

(57) ABSTRACT

A capsule dispenser for dispensing one of a plurality of capsules includes a blister pack having a plurality of cavities, where each cavity is configured to releasably retain one of the plurality of capsules. Also included is a puncturable sealing material covering the cavities. A first housing has a dispensing aperture through which a dispensed capsule passes, and a second housing is configured to mate with the first housing to rotatably retain the blister pack therebetween. The blister pack is able to rotate while retained between the first and second housings. A puncture aperture is located in the first housing and is in alignment with the dispensing aperture. The puncture aperture is configured to permit finger force to be applied to a cavity of the blister pack.

37 Claims, 2 Drawing Sheets

CAPSULE DISPENSER

CROSS-REFERENCE TO RELATED APPLICATIONS

This application claims the benefit of priority from copending provisional patent application Ser. No. 60/379,168, filed May 9, 2002, entitled Capsule Dispenser. Provisional patent application Ser. No. 60/379,168 is incorporated herein by reference in its entirety.

FIELD OF THE INVENTION

The present invention relates generally to a method and apparatus for dispensing pills or capsules, and method for making same, and more specifically to a child-resistant and "seniorfriendly" capsule dispenser capable of dispensing capsules.

BACKGROUND

A need exists to permit medicine, such as pills and capsules to be dispensed at the appropriate time or day. Also, such dispensers should be child-resistant while at the same time, should not present an undue impediment to the elderly. Child-resistant containers are known, such as screw-top bottles and flip-top bottles with locking mechanisms. However, it has been found that such bottles are very difficult for many elderly people to open, either due to reduced vision or poor manual dexterity caused by arthritis or other ailments.

Blister packs are also known. Blister packs typically are formed of plastic or other flexible material and have a plurality of depressions or blisters that receive the pill or capsule. One side of the blister pack is then covered with a foil material to secure the pill or capsule in place. Sufficient finger pressure applied against the convex portion of the blister causes the capsule to break through the foil material to release the capsule or pill. Blister packs by themselves, however, do not provide a child-resistant dispenser nor do they it facilitate sequential release of designated medicine.

SUMMARY

The disadvantages of present capsule dispensers may be substantially overcome by providing a novel capsule dispenser. More specifically, in one embodiment, a capsule dispenser for dispensing one of a plurality of capsules includes a blister pack having a plurality of cavities, where each cavity is configured to releasably retain one of the plurality of capsules. Also included is a puncturable sealing material covering the cavities. A first housing has a dispensing aperture through which a dispensed capsule passes, and a second housing is configured to mate with the first housing to rotatably retain the blister pack therebetween. The blister pack is able to rotate while retained between the first and second housings. A puncture aperture is located in the first housing and is in alignment with the dispensing aperture. The puncture aperture is configured to permit finger force to be applied to a cavity of the blister pack.

BRIEF DESCRIPTION OF THE DRAWINGS

The features of the present invention which are believed to be novel are set forth with particularity in the appended claims. The invention, together with further objects and advantages thereof, may best be understood by reference to the following description in conjunction with the accompanying drawings.

DETAILED DESCRIPTION

In this written description, the use of the disjunctive is intended to include the conjunctive. The use of definite or indefinite articles is not intended to indicate cardinality. In particular, a reference to "the" object or thing or "an" object or "a" thing is intended to also describe a plurality of such objects or things.

Figure 1:
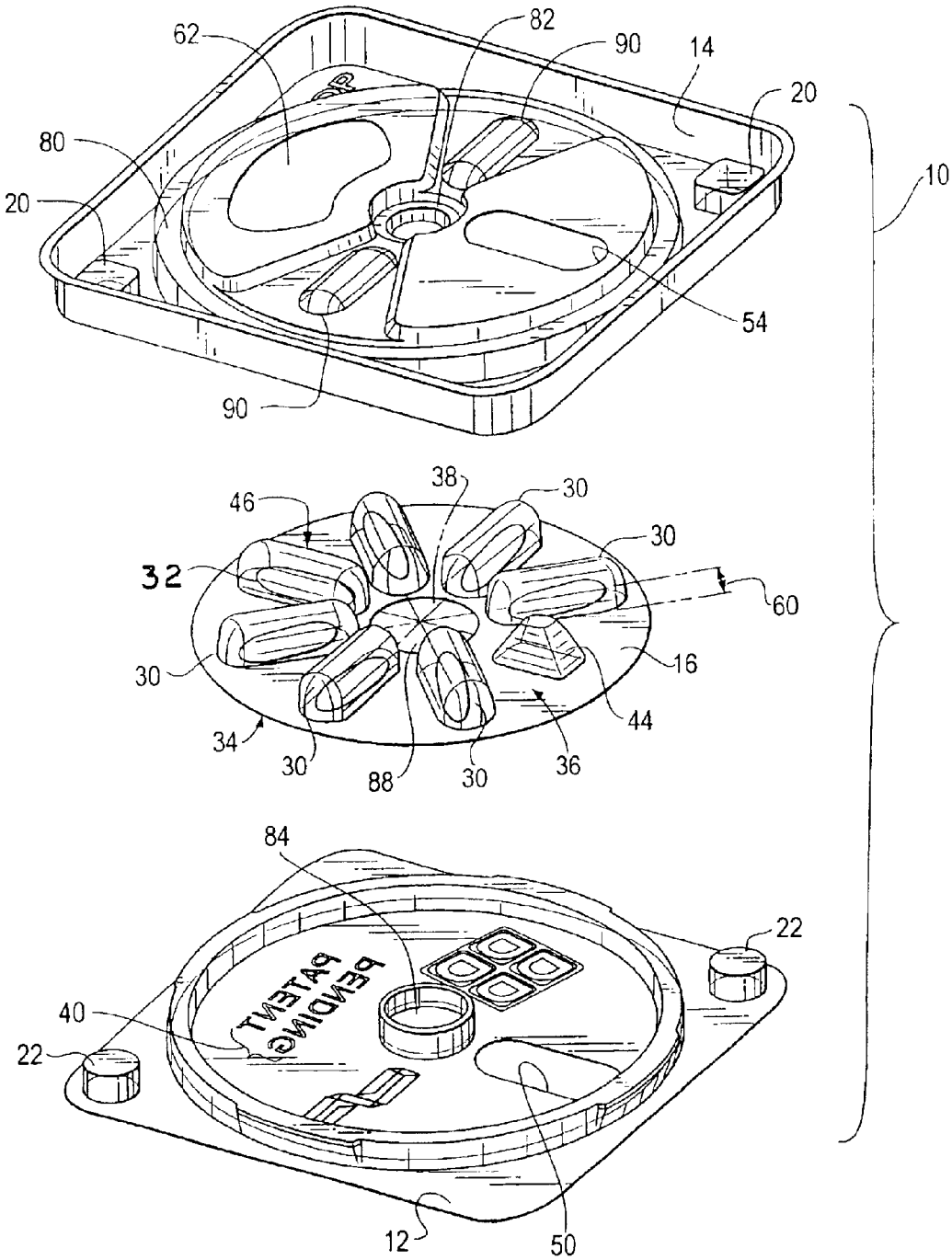
FIG. 1 is an exploded perspective view of a specific embodiment of a capsule dispenser, according to the present invention.

Referring now to FIG. 1, an exploded view of a capsule dispenser 10 is shown. Note that the term "pill" "capsule," "tablet" and the like are used interchangeably herein. The capsule dispenser 10 is shown unassembled and includes a bottom or first housing 12, a top or second housing 14, and a blister pack 16.

The first housing 12 is configured to mate with the second housing 14 to rotatably retain the blister pack 16 between the two housings. The blister pack 16 is able to freely to rotate while retained between the first and second housings 12, 14. The second housing 14 may contain one or more formed recesses 20 that may receive corresponding raised bosses 22 formed in the first housing 12. As shown in the illustrated embodiment, two such recesses 20 and bosses 22 are shown at opposite corners of the housings 12, 14, but a greater number or fewer number of respective recesses and bosses may be used to mate the housings. Such recesses and bosses 20, 22 may also be referred to as "buttons," which may provide a frictional interference fit that resist separation of the housings 12, 14 once mated.

Alternatively, the housings 12, 14 may be heat welded or ultrasonically spot welded to prevent separation. Any suitable method or technique for securing two housing halves 12, 14 together may be used, as may be dictated by manufacturing methods and production costs. As another alternative, the first and second housings 12, 14 may be mated using a hinged or hinge-less "clam shell" type of arrangement, as is known in the art.

The first and second housings 12, 14 may be thermoformed from a suitable plastic material. The housings 12, 14 are preferably formed of plastic, such as polyvinyl chloride (PVC), PETG, polyethylene, polypropylene, polycarbonate, and the like. However, any suitable plastic or non-plastic material may be used. The top and bottom housings 12, 14 are preferably manufactured using a thermoforming process rather than an injection molding process. Thermoforming may be less expensive than thin wall injection molding because the molds and equipment are less expensive, the cycle time of thermoformed articles is much greater than for similar injection molded articles, and the process is less complex generally.

Turning now to the blister pack 16, the blister pack includes a plurality of "blisters" or cavities 30 configured to releasably retain a plurality of capsules 32, respectively. As shown in the specific illustrated embodiment, the blister pack 16 contains cavities 30 for seven capsules 32, which may correspond to the days of the week. However, any convention may be used, such as days of the week, hours of the day, and the like. Note that the invention 10 is not limited to a blister pack 16 having seven cavities 30, and any suitable number of cavities may be used, of course, depending upon the size or diameter of the blister pack 16 and the size of the pill or capsule 32 contained within the cavity. As is known in the art, a bottom surface 34 of the blister pack 16 may be covered with a sealing material 36, which covers the opening of the cavities 30, and releasably retains the capsules 32 in their respective cavities. The bottom surface 34 of the blister pack 16 is preferably generally planar, while the opposite side contains the reverse contour of the cavities 30, which cavities appear as raised bulges or convex forms.

The blister pack 16 is preferably circular, but any suitable shape may be used as long the blister pack is able to rotate within the mated housings 12, 14. Use of a circular blister pack 16, however, permits more efficient use of the "real estate" compared to a square blister pack, but again, production costs and manufacturing techniques may dictate such considerations. Preferably, each cavity 30 is disposed along a radii 38 of the blister pack 16 at evenly spaced arcuate sectors. However, the cavities 30 may be positioned at any suitable place on the blister pack 16, as may be dictated by the type of medication dispensed, the number of capsules 32 dispensed per dose, and the like. For example, although not shown in the illustrated embodiment, two or more cavities 30 may be located adjacent each other (side-by-side), or may be located in-line along the radius 38 of the blister pack 16. This may be desirable, for example, if two or more capsules 32 or two or more different types of medication must be dispensed at the same time so as to constitute a single dose.

Further, the blister pack 16, the reverse face of the foil covering 36, or the housings 12, 14, may be marked with suitable text 40 to inform the patient of the particular day or time to take the medication. As shown in the illustrated embodiment of FIG. 1, seven cavities 30 for containing seven capsules 32 and one "dummy" or blank cavity 44 may be included. The dummy cavity 44 need not be dimensioned to contain a capsule 32, and may be positioned in an initial position so that when the user first uses the dispenser 10, he or she does not inadvertently dispense the first capsule. Accordingly, the user must intentionally rotate the blister pack 16 within the housings 12, 14 to place the first capsule 32 in the dispensing position, as will be described below. This also assists in preventing a child from inadvertently dispensing a capsule.

The sealing material 36 is preferably foil which is secured to the bottom surface 34 of the blister pack 16 with a suitable chemical adhesive or heat seal, as is known in the art. The sealing material 36 is sufficiently strong to retain the capsules 32 within the cavity 30, but is designed to burst or puncture when finger pressure greater that a predetermined amount is applied to the opposite side or the convex side of the cavity, as shown by an arrow 46. The thickness and the material used to form the foil 36 may determine its bursting strength. Note that although the dummy cavity 44 preferably does not contain a capsule 32, it may nevertheless be covered by the sealing or foil material 36.

The first housing 12 may include a dispensing aperture 50 through which a dispensed capsule 32 may pass. Preferably, the dispensing aperture 50 is die-cut and may be dimensioned to circumscribe the shape of the cavity 30, which is accessible in the blister pack 14. The dispensing aperture 50 is vertically adjacent to and is in a plane parallel to the foil or sealing material 36 of the blister pack 16 when the blister pack is retained between the first and second housings 12, 14.

The second housing 14 may include a puncture aperture 54, which may be in alignment with the dispensing aperture 50 when the first and second housings 12, 14 are mated. The puncture aperture 54 is also preferably die-cut and may be dimensioned to circumscribe the shape of the cavity 30 accessible in the blister pack 16. The puncture aperture 54 is vertically adjacent to but slightly spaced above the non-foil side of the blister pack 16 so that the bulging or convex portion of the cavity 30 is accessible through the puncture aperture 54 when the blister pack 16 is retained between the first and second housings 12, 14. The plane of the puncture aperture 54, and hence the puncture aperture itself, is raised above the plane of the blister pack 16 by an amount about equal to a height 60 of the cavity 30. This permits the cavities 30 to rotate below the plane of the second housing 14 without intersecting or being received through or blocked by the puncture aperture 54. The puncture aperture 54 permits a user to contact the convex portion of a specific cavity 30 through the puncture aperture 54 to apply downward force to the capsule 32 within the cavity.

In operation, the blister pack 16 is rotated to a selected position and the user applies finger force against the capsule 32 to cause the capsule to press against the foil 36 covering. When sufficient force is applied, the capsule 32 may then burst through the foil 36 covering and be released from the blister pack 16. The capsules 32 then passes through the dispensing aperture 50.

To rotate the blister pack 16 within the sealed or mated housings 12, 14 to the selected position, a third aperture or housing access aperture 62 is preferably included. As shown in the illustrated embodiment, the housing access aperture 62 is die-cut into the second housing 14. However, it may be die-cut or formed either in the first housing 12 or the second housing 14 with no difference in operational or structural considerations. The housing access aperture 62 is preferably wider than either the dispensing aperture 50 or the puncture aperture 54, and may span, for example, a width or sector defined by two, or slightly greater than two adjacent cavities 30. Any width sufficient to permit a user to insert his or her finger into the housing access aperture 62 and apply rotational force against one of the exposed convex cavities 30 may be used. Finger contact against one of the exposed convex cavities 30 causes the blister pack 14 to rotate within the mated housings 12, 14 so that a capsule 32 may be selected for dispensing by aligning that capsule with the dispensing aperture 50 and the puncture aperture 54. Once the selected capsule 32 is aligned, the user need only push the capsule through the foil 36 covering and the capsule will then exit the cavity 30 through the dispensing aperture 50. Again, as mentioned above, the housing access aperture 62 may be located on either the first or second housing 12, 14 so that rotation of the blister pack 14 may be performed from either the top or bottom of the dispenser 10.

Figure 2:
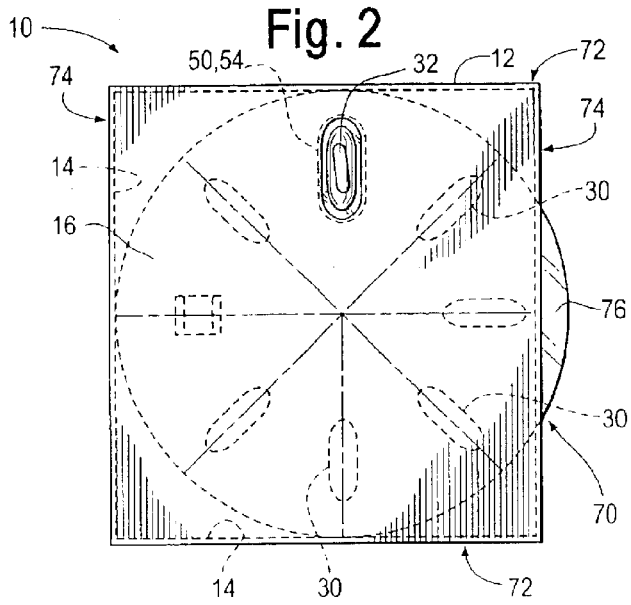
FIG. 2 is a top sectional view of an alternate embodiment of a capsule dispenser.

Alternatively, referring now to FIG. 2, the housing access aperture 62 may be in the form of a thin slot 70 disposed in the side of the first and second housings 12, 14. In this specific embodiment, the first and second housings 12, 14 may not be exactly square in shape, but may, for example, be somewhat rectangular with one pair of opposite sides 72 being shorter than the other pair of opposite sides 74. One of the longer sides 74 may include the slot 70 through with a portion of an edge 76 of the blister pack 16 protrudes. Thus, the user may be able to rotate the blister pack 16 by contacting and rotating the edge 76 of the "disk" defined by the blister pack.

Referring back to FIG. 1, a support structure generally formed in the first and second housings 12, 14 support the blister pack 16 and permit it to rotate. In the illustrated embodiment, the support structure is in the form of an annular shelf 80 that circumscribes a circle in the second housing 14, and having a diameter slightly larger than the diameter of the blister pack 16. In another embodiment, the support structure may be in the form of a raised central hub 82 in the second housing 14, which may contact a corresponding hub recess 84 in the first housing 12. In this embodiment, the blister pack 14 may further include a central aperture 88 through which the central hub 82 and corresponding hub recess 84 are received. Thus, the blister pack 14 may rotate about the central hub 82. Of course, the various support structures may be formed in either the first or second housings 12, 14 and are integrally molded therein.

Alternatively, the dispenser 10 may include one or both of the aforementioned support structures, namely the annular shelf 80 and the hub and hub recess 82, 84 arrangement. Any suitable support structure may be used to support the blister pack 16 and permit it to rotate while retained between the first and second housings 12, 14.

Although the blister pack 16 may freely rotate within the first and second housing 12, 14 by virtue of the supporting structure, preferably, a frictional or "click" stop is included to prevent completely free rotation. To add resistance to such free rotation, one or more "capsule stops" 90 may be formed in the second housing 14. The capsule stops 90 are aligned with the cavities 30 of the blister pack 16 and are convex in the same direction. In other words, as the blister pack 16 is rotated, each cavity 30 (the bulging or convex side of the cavity) of the blister pack is temporarily received in or seated within the capsule stop 90. In the specific illustration of FIG. 1, two such capsule stops 90 are included. Accordingly, as the blister pack 16 is rotated, two capsule stops 90 simultaneously receive two cavities 30 of the blister pack. Of course, this does not prevent full rotation of the blister pack 16, but rather, provides a specific angular stop so that additional rotational force applied to the blister pack dislodges the convex portion of the capsule 30 from the capsule stop 90 so that the blister pack may be rotated to the next capsule position. Because the first and second housings 12, 14 are flexible, such rotation may cause the housings to flex relative to each other to permit the capsules 32 to enter and "click out" of the capsule stops 90. Essentially, the housings 12, 14 may slightly deform or separate as the blister pack 16 is rotated. The capsule stops 90 releasably resist rotation of the blister pack 16.

The capsule stops 90 may be in the form of open or closed cavities 30 or any form of suitable depression. Alternatively, the capsule stops 90 may be in the form of a raised tab or biasing element (not shown) that brushes against the bulged or convex portion of the cavity 30 as the blister pack 16 rotates.

As discussed above, several features of the dispenser 10 provide child-resistant properties, while permitting elderly individuals to dispense capsules 32 from the dispenser 10 without undue difficulty, i.e., it is "senior-friendly." First, when the dispenser 10 is initially purchased, the dummy capsule 44 is in alignment with the dispensing aperture 50 and the puncture aperture 54. A small child may not be able to free the capsule 32 from the capsule because it is not visible to the child nor is it aligned with the puncture aperture 54 and the dispensing aperture 50. An elderly person, however, will easily recognize that the blister pack 16 must first be rotated to align an actual capsule 32 with the dispensing aperture 50 and the puncture aperture 54. Even when the capsule 32 is aligned with the dispensing aperture 50 and the puncture aperture 54, a child may not have the strength or manual dexterity to push against the capsule to rupture the foil 36 and release the capsule 32, while an elderly adult most likely will be able to do so.

Figure 3:
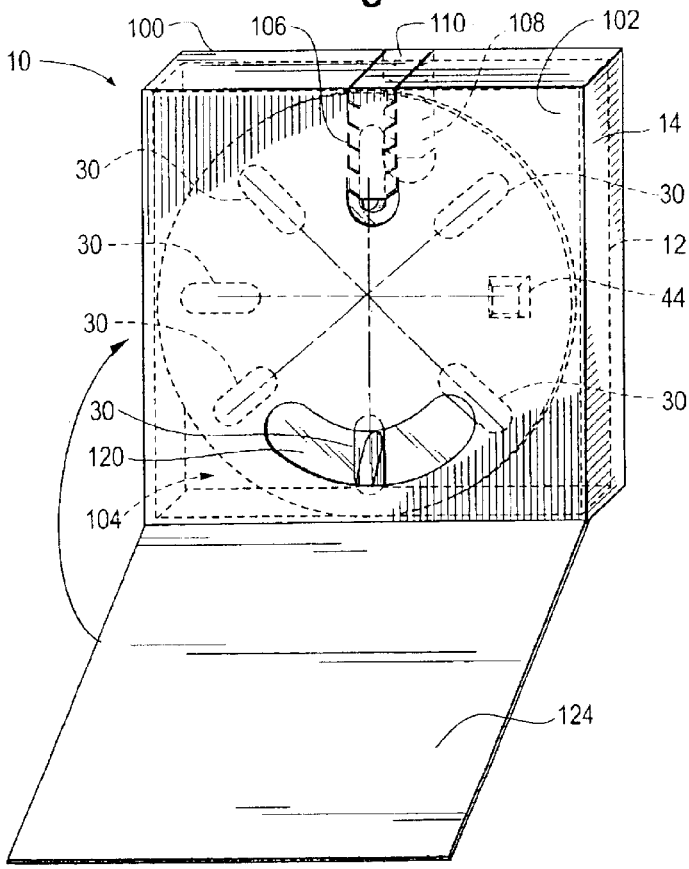
FIG. 3 is a perspective view of an alternate embodiment of the capsule dispenser of FIG. 1 shown enclosed in a protective enclosure to provide further child-resistant features.

Referring now to FIGS. 1 and 3, additional child-resistant features are shown in FIG. 3. In this specific embodiment, the mated first and second housings 12, 14 may be further enclosed in a package or sealed box 100, such as a cardboard box. Note that in this embodiment, eight cavities 30 and one dummy cavity 44 are shown. As mentioned above, any suitable number of cavities 32 may be provided without departing from the scope of this invention. The dispenser 10, including the first and second housings 12, 14, and the blister pack 16 retained therein, may be enclosed in the box 100 of similar dimension and configured to sealingly enclose the housings 12, 14. The packaging or box 100 may include a top side 102 and a bottom side 104. The top side 102 may further include a first perforated portion 106 in alignment with the puncture aperture 54, while the bottom side 104 may include a second perforated portion 108 in alignment with dispensing aperture 50.

Alternatively, the perforations 106, 108 may be a single contiguous piece that spans three sides of the box 100, namely, a portion of the top side 102, a portion of the bottom side 104, and the entire width. 110 of the box connecting the top and bottom sides, so that only a single action of removing the continuous perforation removes the material from both the top and bottom sides of the box. This makes removal of the perforation quick and easy, and also exposes and permits access to the puncture aperture 54 and the dispensing aperture 50 in the housings 12, 14 sealed within the box 100. The perforated portions 106, 108 may present an additional barrier to a child because such gripping and removal of the perforated portions may be difficult for a child to perform. If the perforated portions 106, 108 cannot be removed, the corresponding apertures 50, 54 cannot be accessed, and the capsules 32 cannot be dispensed.

To permit the user to rotate the blister pack 16 externally from the box 100, the box may include a box access aperture 120 in alignment with the housing access aperture 62 to permit finger contact with a portion of the blister pack 16. The box access aperture 120 may be perforated for easy removal, or it may be in the form of a fully open aperture, which may be cut from the box 100 during manufacture. Accordingly, the dispensing aperture 50 and puncture aperture 54 in the top and bottom housings 102, 104, respectively, correspond with and are in alignment with the apertures in the box 100 created by removal of the first and second perforated portions 106, 108. Thus, in operation, after the user removes the first and second perforated portions 106, 108 of the box 100, the dispensing aperture 50 and the puncture aperture 54 of the housings 12, 14 are exposed and are accessible. The user then rotates the blister pack 16, which is exposed through both the box access aperture 120 and the housing access aperture 62.

When the selected capsule 32 is in alignment, the user applies finger force against the capsule to cause the capsule to press against the foil covering 36. When sufficient force is applied, the capsule 32 may then burst through the foil covering 36 and may be released from the blister pack 16. The capsules 32 then passes through the dispensing aperture 50 and through the aperture in the box 100. The box 100 may further include a flap 124 that covers the entire top side 102 of the box, which may further discourage a child from accessing the dispenser.

Specific embodiments of a capsule dispenser according to the present invention have been described for the purpose of illustrating the manner in which the invention may be made and used. It should be understood that implementation of other variations and modifications of the invention and its various aspects will be apparent to those skilled in the art, and that the invention is not limited by the specific embodiments described. It is therefore contemplated to cover by the present invention any and all modifications, variations, or equivalents that fall within the true spirit and scope of the basic underlying principles disclosed and claimed herein.

What is claimed is:

1. A capsule dispenser for dispensing one of a plurality of capsules, the dispenser comprising:

a blister pack having a plurality of cavities, each cavity configured to releasably retain one of the plurality of capsules;

a puncturable sealing material covering the cavities;

a first housing having a dispensing aperture through which a dispensed capsule passes;

a second housing configured to mate with the first housing to rotatably retain the blister pack therebetween, the blister pack able to rotate while retained between the first and second housings;

a puncture aperture located in the first housing and in alignment with the dispensing aperture, the puncture aperture configured to permit finger force to be applied to a cavity of the blister pack; and a housing access aperture in at least one of the first and second housings to permit finger contact with a portion of the blister pack, said finger contact configured to rotate the blister pack to align a selected cavity with the puncture aperture and the dispensing aperture.

2. The capsule dispenser according to claim 1 wherein the housing access aperture has a width about equal to a distance between two adjacent capsules.

3. The capsule dispenser according to claim 1 wherein the sealing material is foil.

4. The capsule dispenser according to claim 1 wherein force applied to the cavity greater than a predetermined amount causes the capsule to puncture the sealing material, exit the cavity, and pass through the dispensing aperture.

5. The capsule dispenser according to claim 1 wherein the blister pack is circular.

6. The capsule dispenser according to claim 1 wherein the cavities are arranged along a plurality of radii of the blister pack, respectively.

7. The capsule dispenser according to claim 1 wherein the sealing material is configured to prevent inadvertent dislodgement of the capsule from the blister pack.

8. The capsule dispenser according to claim 1 further including a frictional stop disposed in at least one of the first and second housings, the frictional stop configured to releaseably contact a cavity as the blister pack is rotated.

9. The capsule dispenser according to claim 8 wherein the frictional stop is in the form of a depression that deformingly contacts a portion of a cavity to releasably resist rotation of the blister pack.

10. The capsule dispenser according to claim 8 further including a biasing element that releasably resists rotation of the blister pack within the housings.

11. The capsule dispenser according to claim 1 further including a support structure in at least one of the first and second housings.

12. The capsule dispenser according to claim 11 wherein the support structure is an annular shelf.

13. The capsule dispenser according to claim 11 wherein the support structure is a substantially planar circular portion having a central raised hub.

14. The capsule dispenser according to claim 11 wherein the support structure is a central hub.

15. The capsule dispenser according to claim 1 further including a packaging enclosure configured to sealingly enclose the housings, the packaging enclosure having top and bottom portions, the top portion having a perforated portion in alignment with the puncture aperture, the bottom portion having a perforated portion in alignment with dispensing aperture so that removal of the perforated portions permits access to the puncture aperture and the dispensing aperture, respectively.

16. The capsule dispenser according to claim 15 wherein the perforated portions present a barrier, the removal of which is difficult for a child to perform.

17. The capsule dispenser according to claim 15 further including a box access aperture in alignment with the housing access aperture to permit finger contact with a portion of the blister pack, said finger contact configured to rotate the blister pack to align a selected cavity of the blister pack with the puncture aperture and the dispensing aperture.

18. The capsule dispenser according to claim 1 wherein the first and second housings are made using a thermoforming process.

19. A capsule dispenser for dispensing one of a plurality of capsules, the dispenser comprising:

a blister pack having a plurality of cavities, each cavity configured to releasably retain one of the plurality of capsules;

a puncturable sealing material covering the cavities;

a first housing having a dispensing aperture through which a dispensed capsule passes;

a second housing configured to mate with the first housing to rotatably retain the blister pack therebetween, the blister pack able to rotate while retained between the first and second housings;

a puncture aperture located in the first housing and in alignment with the dispensing aperture, the puncture aperture configured to permit finger force to be applied to a cavity of the blister pack; and a housing access aperture in either the first or second housings to permit finger contact with a portion of the blister pack, said finger contact configured to rotate the blister pack to align a selected cavity with the puncture aperture and the dispensing aperture.

20. The capsule dispenser according to claim 19 further including a housing access aperture in at least one of the first and second housings to permit finger contact with a portion of the blister pack, said finger contact configured to rotate the blister pack to align a selected cavity with the puncture aperture and the dispensing aperture.

21. The capsuled dispenser according to claim 20 wherein the housing access aperture has a width about equal to a distance between two adjacent capsules.

22. The capsule dispenser according to claim 19 wherein the sealing material is foil.

23. The capsule dispenser according to claim 19 wherein force applied to the cavity greater than a predetermined amount causes the capsule to puncture the sealing material, exit the cavity, and pass through the dispensing aperture.

24. The capsule dispenser according to claim 19 wherein the blister pack is circular.

25. The capsule dispenser according to claim 19 wherein the cavities are arranged along a plurality of radii of the blister pack, respectively.

26. The capsule dispenser according to claim 19 wherein the sealing material is configured to prevent inadvertent dislodgement of the capsule from the blister pack.

27. The capsule dispenser according to claim 19 further including a frictional stop disposed in at least one of the first and second housings, the frictional stop configured to releaseably contact a cavity as the blister pack is rotated.

28. The capsule dispenser according to claim 27 wherein the frictional stop is in the form of a depression that deformingly contacts a portion of a cavity to releasably resist rotation of the blister pack.

29. The capsule dispenser according to claim 27 further including a biasing element that releasably resists rotation of the blister pack within the housings.

30. The capsule dispenser according to claim 1 further including a support structure in at least one of the first and second housings.

31. The capsule dispenser according to claim 30 wherein the support structure is an annular shelf.

32. The capsule dispenser according to claim 30 wherein the support structure is a substantially planar circular portion having a central raised hub.

33. The capsule dispenser according to claim 30 wherein the support structure is a central hub.

34. The capsule dispenser according to claim 19 further including a packaging enclosure configured to sealingly enclose the housings, the packaging enclosure having top and bottom portions, the top portion having a perforated portion in alignment with the puncture aperture, the bottom portion having a perforated portion in alignment with dispensing aperture so that removal of the perforated portions permits access to the puncture aperture and the dispensing aperture, respectively.

35. The capsule dispenser according to claim 34 wherein the perforated portions present a barrier, the removal of which is difficult for a child to perform.

36. The capsule dispenser according to claim 34 further including a box access aperture in alignment with the housing access aperture to permit finger contact with a portion of the blister pack, said finger contact configured to rotate the blister pack to align a selected cavity of the blister pack with the puncture aperture and the dispensing aperture.

37. The capsule dispenser according to claim 19 wherein the first and second housings are made using a thermoforming process.

* * * * *